United States Patent [19]

Husslein et al.

[11] 4,354,084

[45] Oct. 12, 1982

[54] TWIN BAKING OVEN, PARTICULARLY BUILT-IN BAKING OVEN

[75] Inventors: Julius Husslein, Vachendorf; Johann Klement, Traunreut, both of Fed. Rep. of Germany

[73] Assignee: Bosch Siemens Hausgeräte GmbH, Stuttgart, Fed. Rep. of Germany

[21] Appl. No.: 12,127

[22] Filed: Apr. 13, 1979

[30] Foreign Application Priority Data

Jun. 9, 1978 [DE] Fed. Rep. of Germany ..... 2825461

[51] Int. Cl.[3] ..... H05B 6/64

[52] U.S. Cl. ..... 219/10.55 R; 219/400; 126/21 A

[58] Field of Search ..... 219/10.55 R, 10.55 B, 219/400; 126/1 AA, 1 AD, 1 D, 1 E, 21 A, 21 R, 273 R

[56] References Cited

U.S. PATENT DOCUMENTS

| | | | |
|---|---|---|---|
| 3,485,229 | 12/1969 | Gilliom | 219/400 X |
| 3,818,171 | 6/1974 | Miller et al. | 219/10.55 R |
| 3,889,100 | 6/1975 | Dills | 219/400 R |
| 3,911,893 | 10/1975 | Baker et al. | 126/21 A |
| 4,180,049 | 12/1979 | Carr et al. | 219/10.55 X |

FOREIGN PATENT DOCUMENTS

| | | | |
|---|---|---|---|
| 7027952 | 7/1970 | Fed. Rep. of Germany | . |
| 2310290 | 9/1974 | Fed. Rep. of Germany | . |
| 2841155 | 4/1979 | Fed. Rep. of Germany | 126/1 AE |
| 2852399 | 7/1979 | Fed. Rep. of Germany | 219/10.55 R |

*Primary Examiner*—J. V. Truhe
*Assistant Examiner*—Keith E. George
*Attorney, Agent, or Firm*—Herbert L. Lerner

[57] ABSTRACT

In a double baking oven unit having two baking ovens disposed one above the other and enclosed in a common housing, one of the ovens being a microwave oven, and switching, control and operating devices for both of the ovens disposed in an upper space in the housing, cooling-air channels formed with inlet and outlet openings provided outside the two baking ovens, shielding plates thermally shielding the lower baking oven from the upper baking oven and from the cooling-air channels, the cooling-air inlet opening being located at a lower limit of the housing below the lower baking oven and below a shielding plate associated therewith, the cooling-air outlet opening as well as a blower being connected to an exhaust channel disposed above the upper baking oven.

2 Claims, 6 Drawing Figures

TWIN BAKING OVEN, PARTICULARLY BUILT-IN BAKING OVEN

The invention relates to a twin or double baking oven unit and especially to a built-in baking oven unit having two baking ovens disposed one above the other and enclosed in a common housing, especially a combination baking oven unit, one of the ovens being a microwave oven, and switching, control and operating devices for both of the ovens being disposed in an upper space in the housing, as well as cooling-air channels formed with inlet and outlet openings provided within the housing.

In a heretofore known double baking oven (German Petty Patent DE-Gmb No. 70 27 952), two baking ovens heatable by conventional heating devices are mounted above one another in a housing common to both of the baking ovens. Above the upper baking oven, in this petty patent, a suction device is provided which sucks the rising heated air out of both baking ovens and discharges it to the outside. Due to the fact that heat produced during operation of these baking ovens can rise freely in the common housing, the danger exists of the formation of a hot spot or concentration in the upper region of the housing which can have a detrimental effect upon the functioning of switching and control devices also mounted in the upper region of the housing.

It has become known heretofore from German Published Prosecuted Application DE-AS No. 23 10 290 to provide in individual baking ovens, an air-guidance channel between the muffle of the baking oven and an outer housing, inlet openings for cooling air being provided at a lower region of the housing, and a blower being provided in an upper region of the housing which, at the delivery port thereof, communicates with a largely closed exhaust or blow-off channel leading to the outside. It has been found that such a cooling-air system is adequate for an individual baking oven but not, however, for a double baking oven unit with two baking ovens disposed one above the other wherein heat development of both baking ovens is additive or cumulative and result in a concentration of heat in the upper region of the housing, wherein electric and/or electronic switching and control devices are usually mounted, which has a detrimental effect upon the functioning thereof, especially of the electronic devices.

It is accordingly an object of the invention to provide a double baking oven unit of the type initially mentioned hereinbefore which avoids intense heat development or concentration in the upper part of the housing, especially in view of the limited thermal loadability or stressability of electric or electronic components.

With the foregoing and other objects in view, there is provided, in accordance with the invention, in a double baking oven unit having two baking ovens disposed one above the other and enclosed in a common housing, one of the ovens being a microwave oven, and switching, control and operating devices for both of the ovens disposed in an upper space in the housing, cooling-air channels formed with inlet and outlet openings provided outside the two baking ovens, shielding plates thermally shielding the lower baking oven from the upper baking oven and from the cooling-air channels, the cooling-air inlet opening being located at a lower limit of the housing below the lower baking oven and below a shielding plate associated therewith, the cooling-air outlet opening as well as a blower being connected to an exhaust channel disposed above the upper baking oven.

In accordance with another feature of the invention, the cooling-air channels are located between the housing and the ovens.

In accordance with a further feature of the invention, the common housing is received with clearance within a space formed in a built-in furniture unit, and the cooling-air channels are located between the built-in furniture unit and the baking ovens.

In accordance with an added feature of the invention, the shielding plates are disposed both above and below the lower baking oven and are connected to lateral and rear shielding walls and at least partly define therewith the cooling-air channels.

In accordance with an additional feature of the invention, the common housing is received with clearance within a space formed in a built-in furniture unit and the shielding plates and lateral and rear shielding walls defining with the built-in furniture unit the cooling-air channels therebetween.

In accordance with yet another feature of the invention, the shielding plates and the lateral and rear shielding walls define with the common housing the cooling-air channels therebetween.

As a result of the special type of air guidance or conduction, together with the disposition of the inlet and outlet openings, the cooling air sucked in at the lower housing limit and widely passing around the lower baking oven can flow directly and with a relatively low temperature into the upper housing region and reliably prevent unbearable heating of any control and regulating devices located in this upper housing region. This is especially important when using electronic components for which an ambient temperature of about 70° C. ought not to be exceeded.

In accordance with yet a further feature of the invention, the cooling-air channels, at a location above the upper shielding plate, communicate with a ventilating chamber defined by and between the upper baking oven and the common housing. The cooling air flowing in to the underside of the appliance flows with relatively low temperature very intensively around the upper baking oven as well as the control and regulating devices disposed above this upper baking oven and is directly removed by means of the blower and exhaust channel.

In accordance with yet an added feature of the invention, the blower at the suction port thereof, is disposed in an upper part of the ventilating chamber, the blower having a delivery port communicating with the exhaust channel. In accordance with yet an additional feature of the invention, the double baking oven includes an exhaust air shaft terminating in the exhaust channel and communicating with a cooking chamber formed in the upper baking oven. The main air flow which is caused to flow by the blower exerts a suction action upon the exhaust or waste air produced from the cooking chamber which promotes the removal of this exhaust or waste air.

In accordance with another feature of the invention, the lateral and rear shielding walls in a lower portion of the common housing from part of a frame to which the lower baking oven is fastened, the frame having, in an upper portion thereof, slide rails whereupon the upper baking oven, especially the microwave oven, is slidable as a complete structural unit into and out of the frame, and including preferably adjustable securing means for locking the upper baking oven in position in the frame.

In accordance with a further feature of the invention, the frame is disposed with clearance within a built-in furniture unit so as to form the cooling-air channels at least in part between the lateral and rear shielding walls and inner surfaces of the build-in furniture unit.

In accordance with an added feature of the invention, a cover is provided to which the exhaust channel and the blower associated therewith are secured, the cover being mountable on the frame.

In an especially simple and economical manner, the possibility is thereby afforded of constructing the microwave oven fully independently and inserting it into the housing with a minimum of handles, exact alignment of the front surfaces of both of the baking ovens being attainable, particularly, due to the preferred adjustability of the securing means.

In accordance with an additional fearture of the invention, the upper baking oven is a microwave oven, and a microwave generator with a blower therefor is disposed in the upper space in the housing in addition to the blower connected to the exhaust channel, the blower associated with the microwave generator having a suction port disposed in direct vicinity of the cooling-air inlet opening of the housing. In this manner, this blower is prevented from sucking in heated air flowing around both baking ovens or ensures that this blower can draw the cooling air directly from the outside.

In accordance with another feature of the invention, the double baking oven unit includes a control panel for the upper baking oven disposed on the upper front side of the housing, and a horizontal ventilating strip located above the control panel, the ventilating strip being formed with the cooling-air channel outlet opening extending over two-thirds the length thereof for exhausting hot air from the channel, the cooling-air channel inlet opening extending over the remaining length of the ventilating strip, the suction port of the blower associated with the microwave generator being disposed behind the inlet opening. In accordance with a further feature of the invention, electrical and electronic components affectable by heat i.e. being either highly loaded thermally or heat-sensitive, are disposed in a cooling air flow path extending from the suction port of the blower associated with the microwave generator to cooling-air inlet apertures formed in at least one wall and preferably in the rear and lateral walls, of the housing. In this manner, the blower associated with the microwave generator is additionally employed for intensively cooling especially thermally loaded or stressed as well as especially sensitive components, the cooling of which by the general warm air current rising in the housing having not been so intensive.

In accordance with a concomitant feature of the invention, the housing has a pair of opposing walls formed with a multiplicity of the cooling-air inlet apertures, the suction port of the blower associated with the microwave generator and the electrical and electronic components affectable by heat being disposed eccentrically within a ventilating chamber located above the upper baking oven and in vicinity of one of the lateral walls of the housing, the cooling-air inlet apertures formed in the one lateral wall being greater in number than the inlet apertures formed in the lateral wall opposing the one lateral wall.

Other features which are considered as characterized for the invention are set forth in the appended claims.

Although the invention is illustrated and described herein as embodied in twin-baking oven, particularly built-in baking oven, it is nevetheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
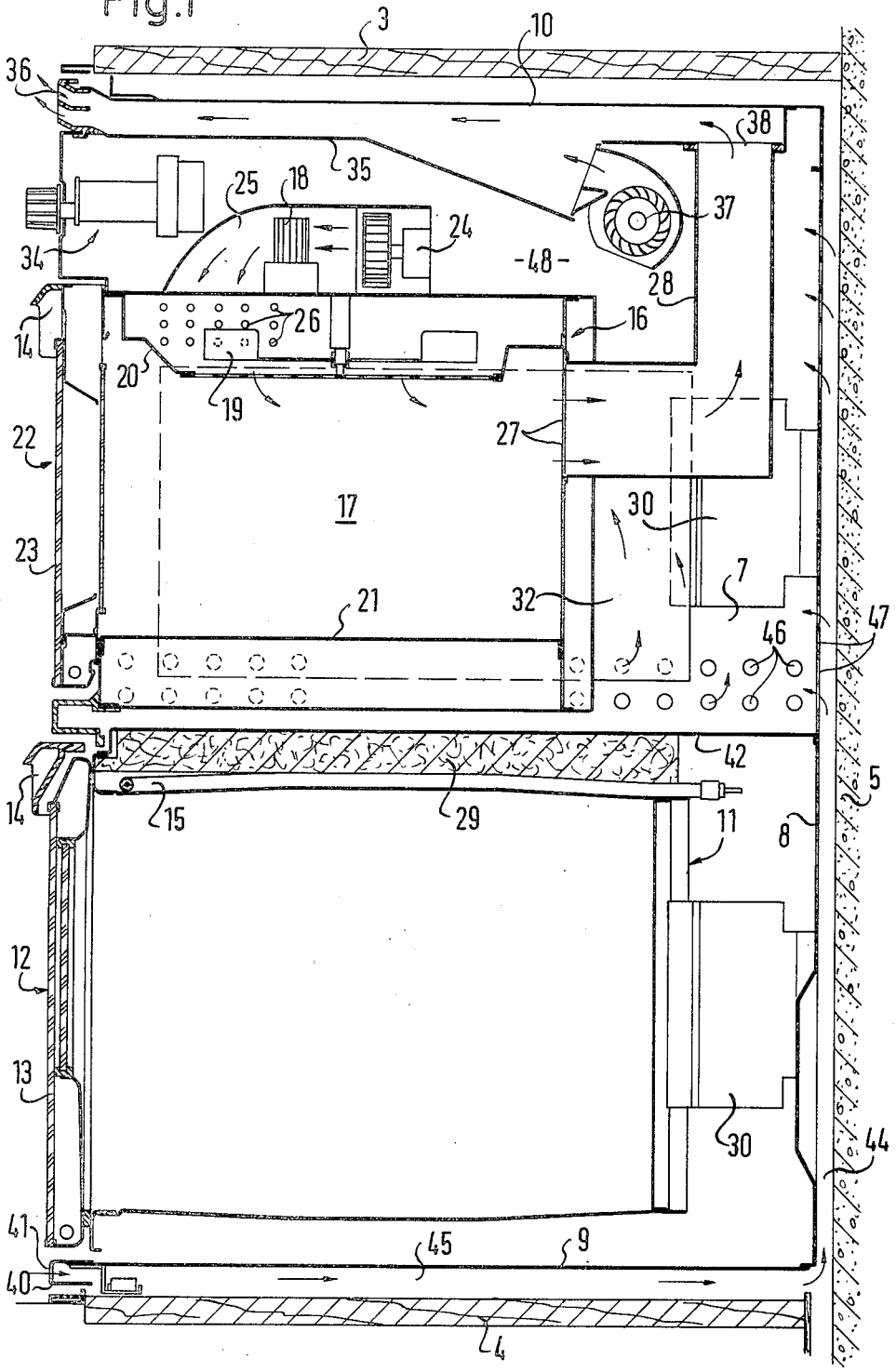
FIG. 1 is a vertical sectional view of the double baking oven according to the invention taken along the line II—II in FIG. 2.
Figure 2:
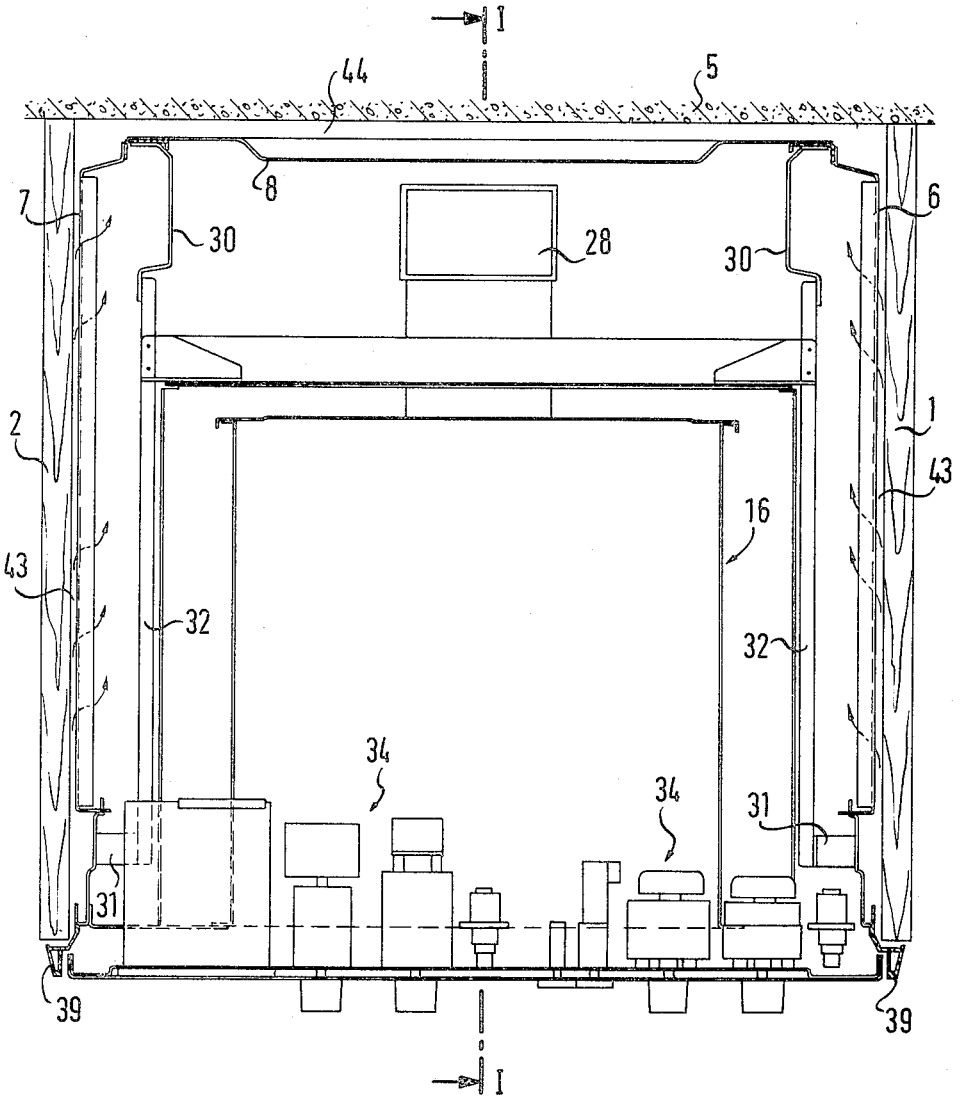
FIG. 2 is a top plan view of the double baking oven open at the top thereof.
Figure 3:
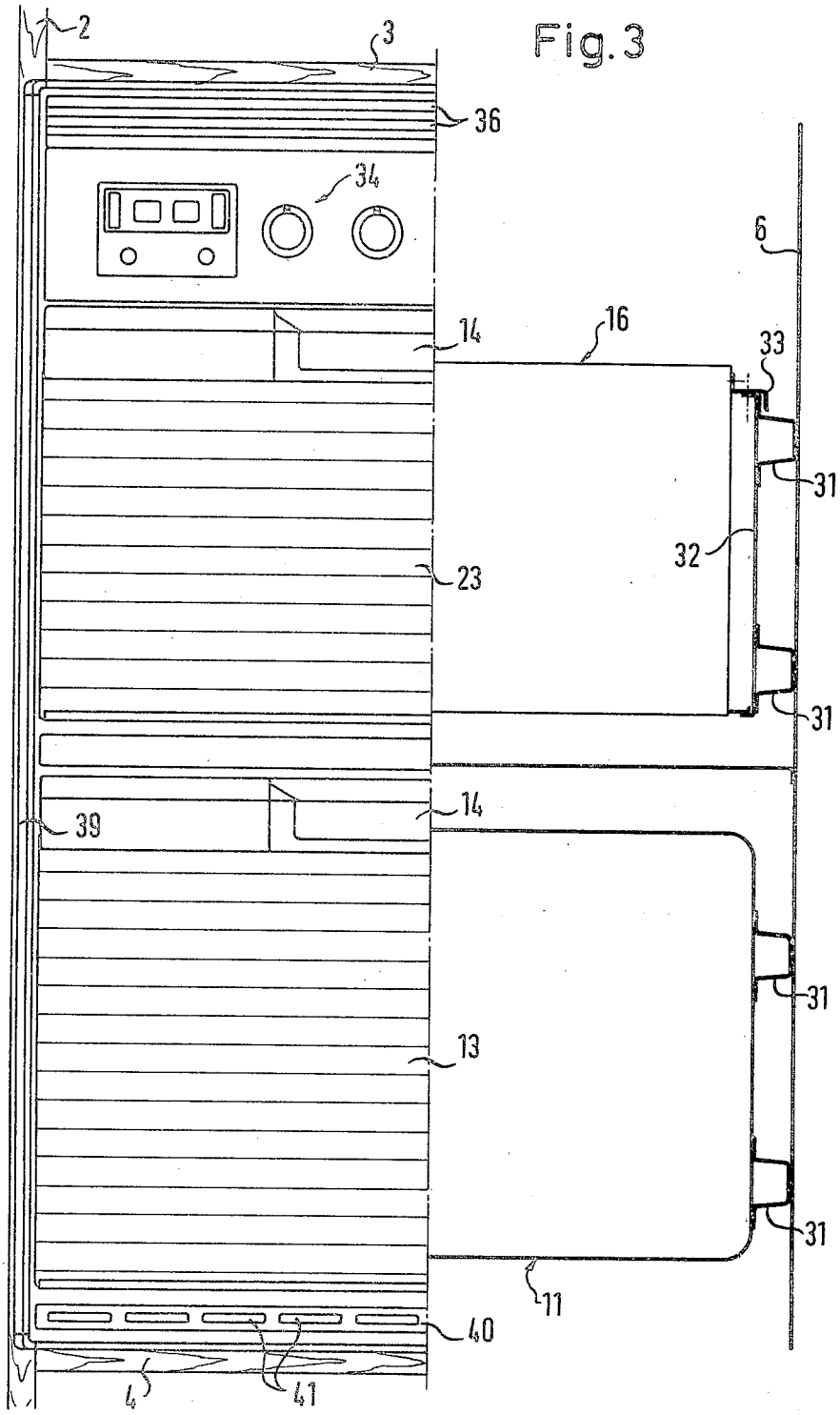
FIG. 3 is a front elevational view of FIG. 1 as seen from the left-hand side of the latter, the housing of the oven being omitted in the right-hand half thereof.

Referring now to the drawing and, first, particularly to FIGS. 1 to 3 thereof, there is shown a double baking oven according to the invention which is installed in a built-in or modular furniture unit formed, for example, of wood panels including side panels 1 and 2, a cover panel 3 and a base panel 4 defining an installation or built-in space for the double baking oven. The built-in furniture unit is mounted on or disposed against a kitchen wall 5. The outer limits of the double baking oven received in the installation space of the built-in furniture unit are formed by opposing lateral walls 6 and 7, a rear wall 8, a lower shielding or protective base 9 as well as an upper cover 10 constituting a housing or frame for the double baking oven. Within this housing or frame there is installed a lower baking oven 11 having a front-sided spring-action door 12 with a front glass plate or panel 13 and a handle 14 as well as conventional heating elements such as a grill heating element 15, as well as upper and lower heaters, and an upper baking oven 16 located above the lower baking oven 11 and being in the form of a microwave oven having a cooking chamber 17 as well as a microwave generator, a microwave conductor or line and a microwave antenna such as a magnetron 18, for example, a conventional air-driven field-agitator 19 within a dielectric covering 20, a rotary table or plate 21 and the like and which is closable at the front side thereof likewise by a spring-action door 22 having a front glass plane 23 and a handle 14. The microwave-baking oven 16 has its own ventilating system with a blower 24, an air duct or channel 25 wherein the magnetron or cooling surfaces thereof are disposed, with injection or blow-in openings 26, outlet openings 27 formed in a rear muffle wall, as well as an L-shaped exhaust-air shaft 28 fastened to the rear muffle wall and having a rectangular cross section. Both baking ovens 11 and 16 are enclosed by thermal insulation layers 29 only one layer of which is shown in FIG. 1.

The lower baking oven 11 is fastened to the rear wall 8 as well as to the lateral walls 6 and 7 by means of baking-oven holders 30 fastened to the rear wall 8 and baking-tube carriers or supporting beams 31 fastened to the lateral walls 6 and 7. Baking tube carriers 31 likewise serve for fastening the microwave oven 16 to the lateral walls 6 and 7, as well as rear baking-oven holders 30 and horizontal slide rails 32 which are fastened to the holders 30 and carriers 31 on both sides of the microwave baking oven 16, the microwave baking oven 16 being slidable as a complete structural unit on the rails 32 into the upper built-in space of the housing or frame by means of bearing angles 33 and being lockable. In order to attain an exactly even alignement of the front glass sides 13 and 23 of both baking ovens 11 and 16, the bearing angles 33 are adjustably applied to the baking oven 16, for example, by a slot guide, and the bearing angles 33 are furthermore, in a similar manner adjustable and connectible to or opposite the slide rails 32 associated therewith, for example, by means of screws or bolts. In a housing space above the upper baking oven 16, electrical or electronic control, regulating and operating or manipulating devices belonging to both baking ovens 11 and 16 are disposed. At the underside of the cover 10 forming the upper limit of the double baking oven, an exhaust channel 35 open at only two opposing sides is fastened, one of the open sides thereof terminating in front-sided upwardly directed outlet openings 36, the exhaust side of a blower 37 likewise fastened to the cover 10 terminating in the other of the open sides of the exhaust channel 35. The exhaust channel 35 has a further opening 38 which, when the cover 10 is placed upon the completely armed housing, is aligned or in registry with the free end of the exhaust air shaft 28 of the microwave baking oven 16 and thus connected therewith.

The outer construction of the double baking oven is further formed of a front-sided, surrounding trim or molding 39 extending over the built-in furniture and formed of sectional or profile material having, at the lowermost transverse strip of molding 40, cooling-air inlet openings 41 and, at the uppermost transverse strip of molding, the hereinaforementioned outlet openings 36.

Directly beneath the lower baking oven 11 or the thermal insulation thereof, the closed shielding base 9 consisting, for example, of steel sheet or plate, and forming the lower limit of the double baking oven, is disposed, while directly above this baking oven 11, another such shielding base 42 is provided. The hereinaforedescribed outer housing i.e. the lateral and rear walls, are spaced such a distance from the inner surfaces of the built-in furniture unit that interconnecting cooling channels 43, 44 and 45 are formed around the housing, the channels 43, 44 and 45 being separated, and largely decoupled thermally, however, from the lower baking oven 11 due to the shielding bases and the rear and lateral walls. Only above the upper shielding base 42 are openings or cut-outs 46 provided in the rear wall 8 as well as in the lateral walls 6 and 7, affording access of the cooling air into the built-in space or ventilating chamber 48 for the upper baking oven 16. The cooling air sucked in through the inlet openings 41 thus enters the cooling channels 45, 44 and 43 and circulates around the lower baking oven 11, rises due to natural convection and due to suction of the blower 37, flows through the ventilating chamber 48 as well as the control and regulating devices 34 and forced by the suction side of the blower 37 into the exhaust or blow-off channel 35 and discharged therefrom into the surroundings. In this regard, due to the forced or positive flow, a suction action is exerted upon the exhaust air shaft 28 which promotes removal or discharge of the exhaust air coming from the cooking chamber of the baking oven 16.

Figure 4:
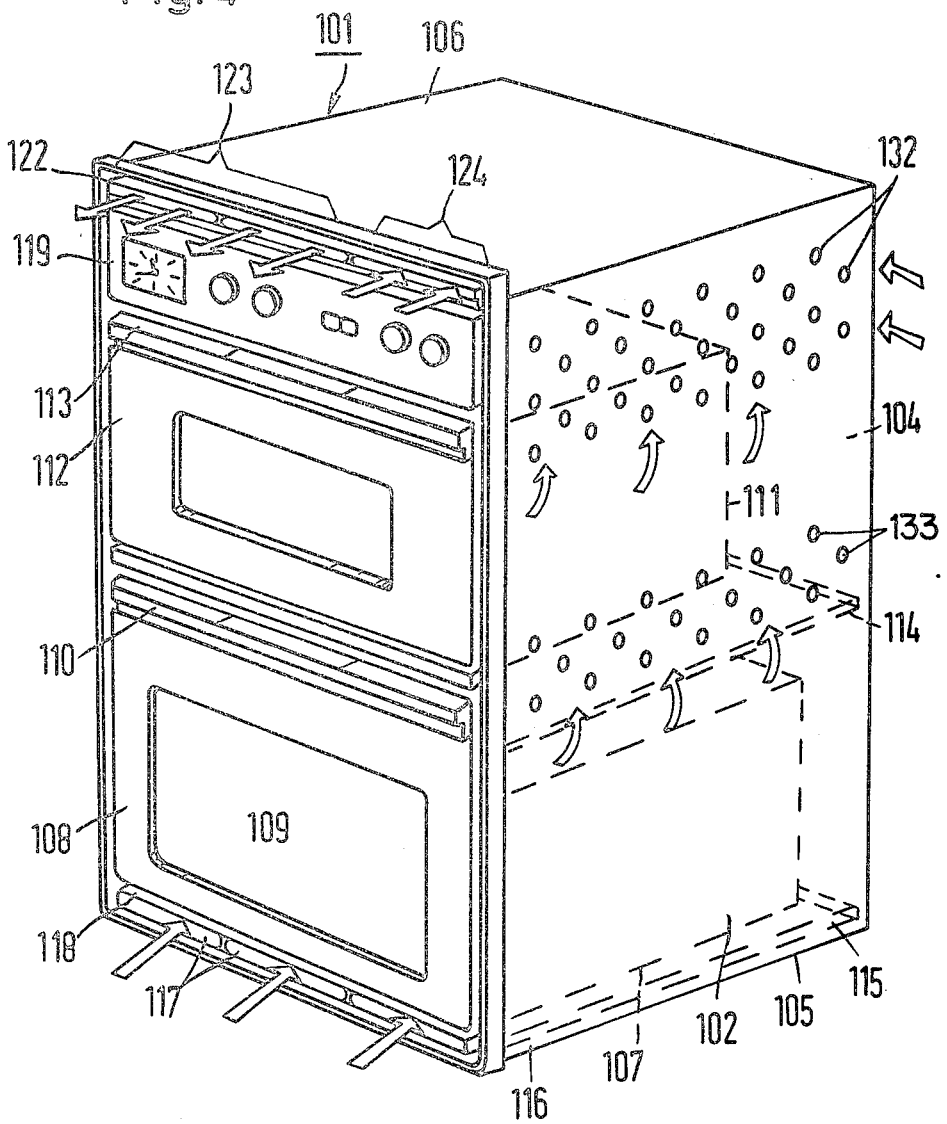
FIGS. 4 and 5 are two different perspective views of another embodiment of the double baking oven of FIGS. 1 to 3.
Figure 5:
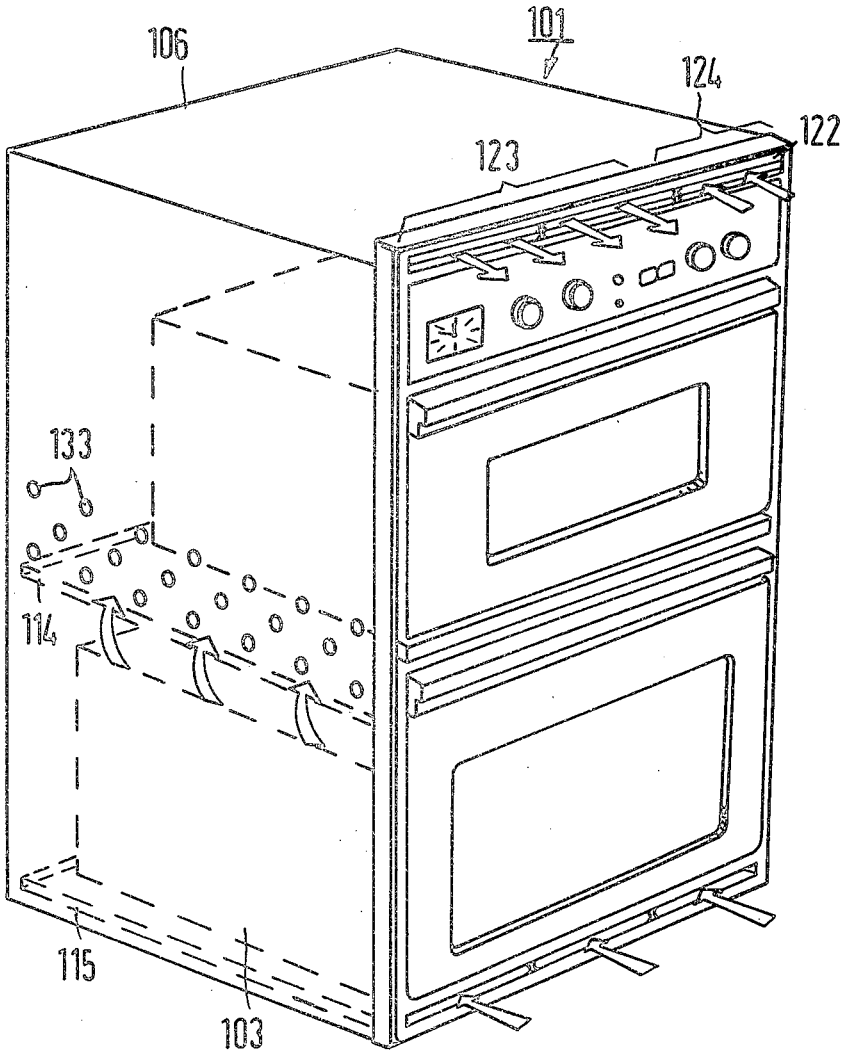
Figure 6:
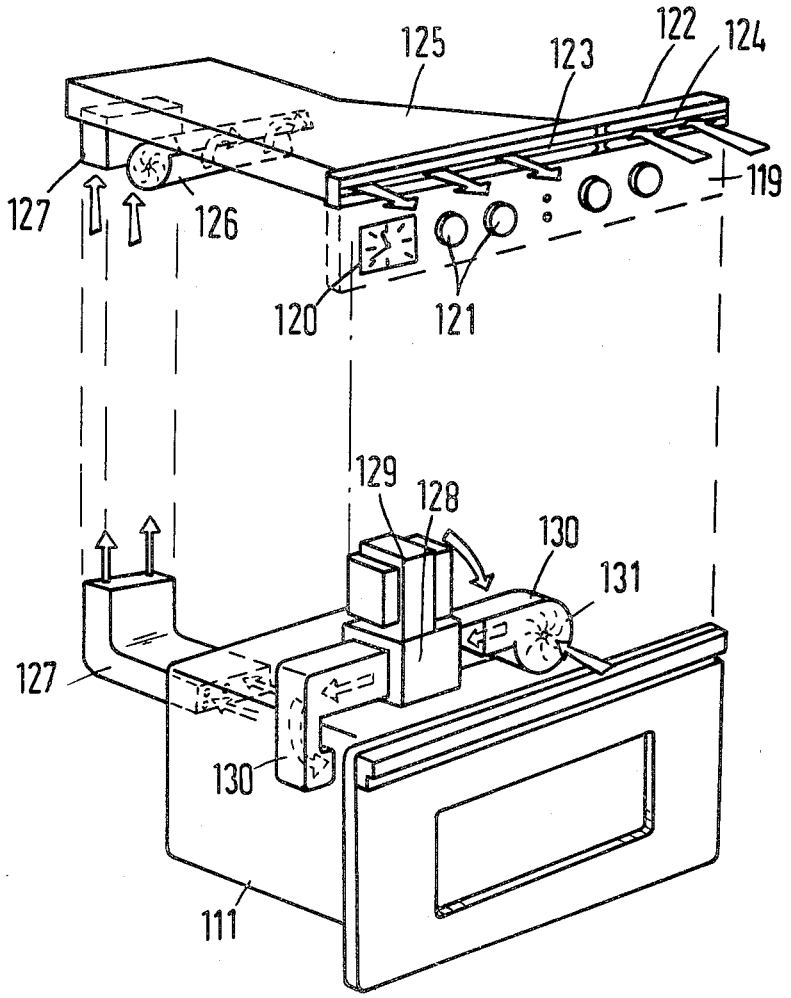
FIG. 6 is a fragmentary exploded view of FIG. 5 partly broken away and diagrammatic.

The double baking oven embodiment shown in FIGS. 4 to 6 of the drawings is mounted in an otherwise non-illustrated built-in furniture unit constructed, for example, of wooden panels, including side wall panels, a cover panel and a base panel, defining a built-in space which is adapted to receive the double baking oven. The outer limit or external surfaces of the double baking oven accommodate within the built-in furniture unit are formed by a housing 101 made up of opposing side walls 102 and 103, a rear wall 104, a base 105 and a cover 106. Mounted in the housing or frame formed by the just-mentioned components are a lower baking oven 107 provided on the front side thereof with a hinged or spring-action door 108 including a front glass panel or window 109 and a handle 110. The lower oven 107 may also have conventional heating elements such as a grilling radiator or grill heating device as well as additional upper and lower heating elements. Also mounted in the housing or frame is an upper baking oven 111 in the form of a microwave oven which is likewise provided with a glass-windowed, hinged or spring-action door 112 having a handle 113. A shielding base or plate 114 is provided between the upper oven 111 and the lower oven 107, and another shielding base or plate 115 is provided beneath the lower oven 107, both of the shielding plates 114 and 115 separating the space containing the lower oven 107 from the remaining space in the housing so as to provide two separate duct systems. Extending between the lower shielding plate 115 and the housing base 105 is a horizontal cooling air shaft or duct 116 which communicates with cooling-air inlet openings or apertures 117 formed in a lower ventilating strip 118. The upper part of the housing and the upper oven 111 associated therewith are separately shown in FIG. 6 wherein, in the interest of clarity, a control panel 119 disposed on the front side of the housing and above the upper oven 111 and associated with both oven 107 and 111 is seen shifted upwardly. The upper edge of the control panel 119, which is provided with a timing clock 120 as well as controls 121, is bordered by a ventilating strip 122 provided with a hot-air outlet opening or aperture 123 which, in the embodiment of FIGS. 4 to 6, extends over two-thirds of the length of the strip, and which is further provided with a cooling air inlet opening or aperture 24 extending approximately over one-third the length of the strip. Connected to the hot-air opening 123, is a largely enclosed hot-air exhaust channel or duct 125 which communicates, at the end thereof remote from the ventilating strip 122, with the delivery port of a blower 126 adapted to produce a transverse air flow and with an exhaust air duct or shaft 127 which, in turn, communicates with the interior of the oven 111. Within the ventilating space, which is in the uppermost part of the housing and which has a lower boundary formed by the top of the upper oven 111 and an upper boundary formed by the housing cover 106, there is disposed a microwave generator generally identified by the reference numeral 128 and including a transformer 129. The microwave generator 128 and the transformer 129 are disposed in the flow path of a cooling air shaft or duct 130, one end of which communicates with the delivery port of a special second blower 131, and the other end of which is connected to the baking or cooking chamber of the upper oven 111. The blower 131 is disposed in such a manner that the suction port thereof lies directly behind the cooling-air inlet opening or aperture 124 of the ventilating strip 122 so that the blower 131 may directly draw the ambient air as cooling air from the outside of the unit as indicated by the associated arrows in FIG. 6. This cooling air current flows through air shaft or duct 130 and intensively cools the microwave generator 128. As also indicated by the associated arrows in FIG. 6, the warm or hot exhaust air escaping from the interior of the oven 111 is conducted through the exhaust air shaft or duct 127 to the exhaust shaft or duct 125 and is discharged or exhausted from the oven unit through the outlet opening or aperture 123, together with the hot air flowing around the two ovens 107 and 111 and entering the upper part of the housing under the action of natural convection and of the suction effect produced by the blower 126. In FIG. 6, it is shown that the suction part of the blower 131 is disposed in an eccentric position in the ventilating space in vicinity of the housing side wall 102, the same as for otherwise nonillustrated elements including electric or electronic components which are either subject to high thermal loads or particularly sensitive to heat. As compared to the side wall 103 of the housing, the side wall 102 opposing the same is formed with a considerably greater number of cooling-air inlet openings or apertures 132 which are provided in addition to the inlet apertures 133 formed in the lower parts of side walls 102 and 103, the openings or apertures 132 being disposed in vicinity of the upper edge of side wall 102. In this manner, there is produced between the suction port of the blower 131 and the inlet openings or apertures 132 thereof, a forced cooling air flow, generally indicated by arrows in FIG. 4, this air flow coming into contact with the hereinaforementioned components including the control elements, the transformer 29 and the like, without being intermixed to any major extent with the general warm or hot air flow. Similar inlet openings or apertures may be additionally provided in the rear wall 104 of the housing.

There is claimed:

1. In a double baking oven unit having two baking ovens disposed one above the other and enclosed in a common housing, one of the ovens being a microwave oven, and switching, control and operating devices for both of the ovens disposed in an upper space in the housing, cooling-air channels formed with inlet and outlet openings provided outside the two baking ovens, shielding plates thermally shielding the lower baking oven from the upper baking oven and from said cooling-air channels, said cooling-air inlet opening being located at a lower limit of the housing below the lower baking oven and below a shielding plate associated therewith, said cooling-air outlet opening as well as a blower being connected to a common exhaust channel disposed above the upper baking oven drawing air from said cooling-air inlet opening in the form of a first ventilating system, the upper baking oven being a microwave oven, and including a microwave generator with a blower therefor disposed in the upper space in the housing in addition to said blower connected to said exhaust channel, said blower associated with said microwave generator having a suction port disposed in direct vicinity of an additional cooling-air inlet opening of the housing and having an outlet port being in communication with said common exhaust channel through said microwave oven forming a second ventilating system, said suction port being disposed between said microwave oven and said additional cooling-air inlet opening for receiving air before it reaches said microwave oven.

2. In a double baking oven unit having two baking ovens disposed one above the other and enclosed in a common housing, one of the ovens beig a microwave oven, and switching, control and operating devices for both of the ovens disposed in an upper space in the housing, cooling-air channels formed with inlet and outlet openings provided outside the two baking ovens, shielding plates thermally shielding the lower baking oven from the upper baking oven and from said cooling-air channels, said cooling air inlet opening being located at a lower limit of the housing below the lower baking oven and below a shielding plate associated therewith, said cooling-air outlet opening as well as a blower being connected to a common exhaust channel disposed above the upper baking oven drawing air from said cooling-air inlet opening in the form of a first ventilating system, the upper baking oven being a microwave oven, and including microwave generator with a blower therefor disposed in the upper space in the housing in addition to said blower connected to said exhaust channel, said blower associated with said microwave generator having a suction port disposed in direct vicinity of an additional cooling-air inlet opening of the housing and having an outlet port being in communication with said common exhaust channel through said microwave oven forming a second ventilating system, a control panel for the upper baking oven disposed on the upper front side of the housing, and including a horizontal ventilating strip located above said control panel, said ventilating strip being formed with said cooling-air channel outlet opening extending over two-thirds the length thereof for exhausting hot air from said channel, said additional cooling-air channel inlet opening extending over the remaining length of said ventilating strip, said suction port of said blower associated with said microwave generator being disposed behind said inlet opening.

* * * * *